US006582054B2

(12) United States Patent
Yamamoto et al.

(10) Patent No.: US 6,582,054 B2
(45) Date of Patent: Jun. 24, 2003

(54) IMAGE FORMING APPARATUS

(75) Inventors: Ryoichi Yamamoto, Kanagawa (JP); Nobuo Matsumoto, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/915,338

(22) Filed: Jul. 27, 2001

(65) Prior Publication Data

US 2002/0015069 A1 Feb. 7, 2002

(30) Foreign Application Priority Data

Jul. 27, 2000 (JP) ..... 2000-227622

(51) Int. Cl.[7] ..... B41J 2/015
(52) U.S. Cl. ..... 347/21; 347/103; 347/43
(58) Field of Search ..... 347/21, 43, 103, 347/110

(56) References Cited

U.S. PATENT DOCUMENTS

| | | | |
|---|---|---|---|
| 4,109,282 A | 8/1978 | Robertson et al. | 358/127 |
| 4,614,953 A | 9/1986 | Lapeyre | 346/140 R |
| 5,371,529 A | 12/1994 | Eguchi et al. | 347/7 |

FOREIGN PATENT DOCUMENTS

| | | |
|---|---|---|
| EP | 1016538 | 7/2000 |
| JP | 3-207664 | 9/1991 |
| JP | 5-201024 | 8/1993 |
| JP | 7-125259 | 5/1995 |
| JP | 9-156131 | 6/1997 |
| JP | 2000-246920 | 9/2000 |

*Primary Examiner*—John Barlow
*Assistant Examiner*—Lam Nguyen
(74) *Attorney, Agent, or Firm*—Birch, Stewart, Kolasch & Birch, LLP

(57) ABSTRACT

An image forming method and apparatus for ejecting a recording fluid constituted by a plurality of inks from a common ink ejection port while a mixing ratio of the plurality of inks is changed with respect to one pixel based on an image signal, and transporting the plurality of inks to an image receiving medium which is moved with respect to the ink ejection port to form an image. An opening area Ai of a channel of an image forming ink is smaller than the opening area of the channel of an image non-forming ink in a confluence (mixing section) of the plurality of inks, and the opening area Ai has the following relationship with a minimum ejection volume Vi of the image forming ink:

$$Ai \leqq 1.2 \times Vi^{(2/3)},$$

so that with an excessively small amount of the image forming ink to be mixed with the image non-forming ink, a leading end of the ink is cut well, an image density having fidelity to the image signal can be obtained, and an image quality can be enhanced.

20 Claims, 13 Drawing Sheets

IMAGE FORMING APPARATUS

FIELD OF THE INVENTION

The present invention relates to an image forming apparatus for generating a recording fluid having a predetermined density and/or a predetermined color by changing a mixing ratio of a plurality of inks based on an image signal and leading the thus obtained fluid to an image receiving medium to form an image.

BACKGROUND OF THE INVENTION

U.S. Pat. No. 4,109,282 (hereinafter referred to as a prior art reference 1) discloses a printer having a structure such that a valve called a flap valve is disposed in a flow channel for leading two types of liquid, i.e., clear ink and black ink onto a substrate for forming an image. The flow channel for each ink is opened/closed by displacing this valve so that the two types of liquid are mixed in a desired density to be transferred onto the substrate. This enables printout of an image having gray scale information which is the same as that of the image information displayed on a TV screen. In this reference is disclosed that a voltage is applied between the flap valve and an electrode disposed on a surface opposite to the flap valve and the valve itself is mechanically deformed by an electrostatic attracting force to cause displacement of the valve. Furthermore, the ink is absorbed in paper by a capillary phenomenon between fibers of the print paper.

U.S. Pat. No. 4,614,953 (hereinafter referred to as a prior art reference 2) discloses a printer head apparatus by which only a desired amount of multiple types of ink having different colors and solvent is led to a third chamber to be mixed therein. In this reference is disclosed that a chamber and a diaphragm-type piezoelectric effect device attached to this chamber are used as means for check-weighing the desired amount of ink and a pressure pulse obtained by driving this piezoelectric device is utilized.

Unexamined Japanese Patent Publication (KOKAI) No. 201024/1993 (hereinafter referred to as a prior art reference 3) discloses an ink jet print head including: a liquid chamber filled with a carrier liquid; ink jet driving means disposed in the liquid chamber; a nozzle communicating with the liquid chamber; and a mixing portion for mixing ink to the carrier liquid in this nozzle. In this reference is also disclosed that adjusting means having a check valve structure for adjusting an amount of mixture of ink to a desired value is provided.

Similarly, Unexamined Japanese Patent Publication (KOKAI) No. 125259/1995 (hereinafter referred to as a prior art reference 4) discloses an ink jet recording head including: first and second supplying means for supplying inks having first and second densities, respectively; and controlling means for controlling an amount of supply of the second ink by the second supplying means so that a desired ink density can be obtained.

In this reference 4, employment of a micro-pump which has an exclusive heating device and is driven by its heat energy is disclosed. As this micro-pump, there is disclosed an example such that the heat energy is generated by the heating device and a pressure obtained by nucleate boiling caused by the heat energy is used to drive, for example, a piston-type valve or a cantilever-like valve. Furthermore, this reference 4 describes that an inflow of ink can effectively be controlled in an area where the inflow is particularly small by adopting an actuator consisting of a shape memory alloy to this valve.

Unexamined Japanese Patent Publication (KOKAI) No. 207664/1991 (hereinafter referred to as a prior art reference 5) discloses a structure which is similar to that in the prior art reference 2 but does not use a third chamber for mixing a plurality of types of ink.

Unexamined Japanese Patent Publication (KOKAI) No. 156131/1997 (hereinafter referred to as a prior art reference 6) discloses an ink jet printer comprising a plurality of printer heads for forming an image having multiple colors based on image data. Ink and diluent are mixed at a predetermined ratio to obtain diluted ink which is jetted from a nozzle so that a recording image is formed on a recording medium. The ink jet printer ejects the diluent from at least one printer head out of the multiple printer heads when all-white image data, that is, data representing that amount of mixture of ink is too small to realize a clear printing density, is input. As a result, a rapid change in tone (a tone jump) is prevented and the additional consumption of the diluent is suppressed to improve drying characteristics.

In the prior art disclosed in the prior art reference 1, the ejection ports for two types of liquid are separately open directly to the print paper, and the respective types of liquid are separately attracted on the print paper by the capillary phenomenon immediately after ejection. Therefore, a quantity of attraction of each liquid on the paper readily fluctuates under influence of a paper quality of the print paper, which results in the unstable image quality or difficulty of formation of an image having high fidelity to the image signal.

In any of the prior art references 2 to 6, a plurality of inks are mixed beforehand or caused to be confluent, and thereafter the mixed liquid (including the confluent liquid) is led onto the print paper. However, when a mixing ratio of one ink is remarkably small (ejection amount is remarkably small), the ink cannot smoothly be confluent with other ink. That is, when the ejection amount of the ink is small, an amount (ingress amount) of the ink advancing to the mixing portion (or a confluence portion) for mixing with the other ink becomes small. Therefore, a leading end of the ink cannot cut in a flow of the other ink by a surface tension of the ink. Therefore, the density of a mixed liquid (confluent liquid) cannot follow the image signal with fidelity, and a problem that an image quality is deteriorated occurs.

Furthermore, in any of the prior arts disclosed in the prior art references 2 to 6, a plurality of inks are brought into contact with one another in the mixing section (the confluence portion), and each ink is ejected by a predetermined amount to be mixed. That is, the ejection port for each ink is formed and assembled in the mixing section. Each ink cannot therefore be prevented from being naturally diffused from one another.

For example, even if a given ink is not ejected into a mixing chamber in accordance with the image signal, this ink is naturally diffused in the mixing chamber. Thus, the density and/or color of the finally mixed ink liquid differs from the image signal, and an image which has fidelity to the image signal cannot be formed. Even if the natural diffusion of the ink is small, distortion of a contact interface occurs due to a vibration in the mixing portion or any other disturbance, and therefore the undesired mixing of ink is facilitated and the above-described problem becomes more prominent.

Additionally, the prior art reference 3 discloses that adjusting means functioning as a check valve is disposed in the vicinity of the opening of the ink channel formed in the mixing portion in order to mainly prevent the inks from being naturally diffused from one another. However, the adjusting means having the check valve structure complicates a print head configuration and leads to problems such as difficulty in manufacturing, reduction of productivity or increase of a manufacturing cost.

Furthermore, the prior art reference 6 discloses that a colorless diluent continues to flow in case of all-white image data in order to avoid a rapid change in tone (tone jump), but the ink which is not colorless and transparent is continuously diffused in this diluent in this case, and hence the above-mentioned problems can not be prevented.

To solve the problem, the present applicant has considered that the small amount of image forming ink is constantly and continuously supplied to the other ink such as a transparent liquid (image non-forming ink) (e.g., Unexamined Japanese Patent Publication (KOKAI) No. 246920/2000 corresponding to EP 101653A2 and U.S. patent application Ser. No. 09/472,970). For example, when the density is controlled in 256 tones, and the image signal indicates "white", the image forming ink corresponding to a smallest density is continuously supplied. In this case, the ejection amount of the image forming ink is remarkably small, and the problem occurs that the leading end of the image forming ink does not cut and cannot be mixed (confluent) with the image non-forming ink.

Particularly in this case, when the "white" image signal continues, the leading end of the image forming ink enters the image non-forming ink by a small amount in accordance with the image signal. When the ingress amount of the image forming ink exceeds a certain limit, the ink is cut and ejected. Therefore, the cut ink soils the image and deteriorates the image quality.

SUMMARY OF THE INVENTION

The present invention has been accomplished under the aforementioned circumstances, and an object thereof is to provide an image forming apparatus in which with a small amount of image forming ink, a leading end of the ink is cut well, and an image density having fidelity to an image signal can be obtained, and an image quality can be enhanced.

According to the present invention, the object is attained by an image forming apparatus for ejecting a recording fluid constituted by a plurality of inks from a common ink ejection port while a mixing ratio of the plurality of inks is changed with respect to one pixel based on an image signal, and transporting the recording fluid to an image receiving medium which is moved with respect to the ink ejection port to form an image; said image forming apparatus comprising:

an ink ejection port for ejecting the recording fluid to the image receiving medium;

a first ink channel for supplying an image non-forming ink to said ink ejection port, the image non-forming ink being an ink for forming no image after dried out;

a second ink channel for supplying an image forming ink to said ink ejection port, the image forming ink being an ink for forming the image after dried out; and a mixing section disposed upstream of said ink ejection port, for mixing the image non-forming ink supplied from said first ink channel and the image forming ink supplied from said second ink channel;

wherein an opening area Ai of said second ink channel is smaller than the opening area of said first ink channel in said mixing section; and the opening area Ai of said second ink channel has the following relationship with a minimum ejection volume Vi of the image forming ink:

$$Ai \leq 1.2 \times Vi^{(1/2)}.$$

The image non-forming ink is constantly supplied, and confluent with the image forming ink, until a predetermined density is obtained. Particularly, when a total flow rate of both inks is constant, the ink is steadily transported to the image receiving medium, and this is further suitable for enhancement of the image quality.

Print paper may be used as the image receiving medium, and the image can directly be formed on this print paper. However, it is also possible to provide a drum-like or belt-like intermediate image receiving medium between the ejection port and the image receiving medium. In this case, an ink liquid supplied from the ejection port is loaded onto an intermediate image receiving medium, and then the ink liquid is transferred to the image receiving medium. Preferably, the ink ejection ports may be separately provided for respective pixels aligned in a width direction of the image receiving medium (a direction perpendicular to a moving direction). The ink ejection ports may be formed into a slot-shaped opening which is elongated in the width direction of the image receiving medium when changing the density and/or the color only in the moving direction of the image receiving medium.

The image non-forming ink is or becomes colorless and transparent after dried out and forms no image (hereinafter referred to as image non-forming ink or clear ink), and the density can be controlled by changing a mixing ratio of the image non-forming ink. It is preferable to constantly add the image non-forming ink to the ink liquid so that a supply amount of the image non-forming ink should not become zero. In this case, when decoloration preventing agents such as antioxidant, ultraviolet ray absorber or other components are included in the image non-forming ink beforehand, a color degradation preventing property and other properties can be imparted to the image. A plurality of image forming inks are determined as inks having colors of yellow, magenta and cyan, and the mixing ratio of these inks can be changed during formation of a color image.

When flow rates of a plurality of inks are controlled, an image can be formed having density and/or color varying in both the moving direction and the width direction of the image receiving medium.

A plurality of inks ejected from the ink ejection port may be transported, that is, jetted onto the image receiving medium as droplets by an ink jet mode, but it is also possible to transport/apply the inks to the image receiving medium as a continuous flow instead of the droplets (continuous coating mode). In this continuous coating mode, a flow of liquid can be ejected or extruded as a continuous flow and transported to the image receiving medium through a slot-opening connecting the ink ejection ports provided for the respective pixels in the width direction.

The image forming ink is controlled in such a manner that a volumetric flow rate per unit time does not constantly turn to zero, and it is then possible to smoothly control the small amount of ink. In this case, a minimum addition amount of the image forming ink may be the same as or larger than a flow rate necessary for refreshing a volume of the image forming ink mixed into another ink by natural diffusion. However, the addition amount should be suppressed to such an extent that a change in density and/or color due to addition of this ink does not result in degradation of the image quality. Therefore, it is preferable to set the additional amount in such a manner that a change in optical density of the ink liquid due to addition of this ink is less than 0.1. Here, the optical density means a degree by which a substance absorbs light. When it is assumed that the optical density is represented as D, an intensity of an incident light is $I_0$, and an intensity of a transmitted light is I, the optical density can be defined by $D=\log_{10}(I_0/I)$. Vibration is preferably absorbed in a portion where a plurality of inks becomes confluent, so that turbulence of a contact interface is prevented from occurring due to vibration and disturbance of the ink, and diffusion may be prevented.

The flow rates of a plurality of inks can be controlled by the various methods. For example, an ink supply pressure with respect to each ink channel can be maintained to be constant while a sectional area of each ink channel can be changed by a piezoelectric device. In this case, a diaphragm valve facing the ink channel is opened/closed by the piezoelectric device. The piezoelectric device can be driven by a mechanical natural frequency (a resonance frequency) of the device itself, and a time period for driving the device is changed by varying a pulse number of this frequency in order to control the flow rate. It is also possible to continuously control a quantity of distortion (opening of the diaphragm valve) of the piezoelectric device by an analog signal and, in this case, the flow rate is controlled by a voltage of the analog signal.

A flow rate supplied to each ink channel may be controlled by changing a discharged quantity of an ink feed pump. For example, the ink feed pump is driven by a pulse motor (stepping motor), and the ink flow rate can be controlled by the driving pulse number of this pulse motor. The ink feed pump includes: at least one check valve disposed in the ink channel; a cavity provided in the vicinity of this check valve; and a movable member for changing a volumetric capacity of the cavity, so that the pump discharges the ink by changing the volumetric capacity of the cavity. Such pump can be used as an ink feed pump.

The check valve used in the ink feed pump may be constituted by a geometrical form by which a resistance relative to an ink flow direction becomes small and that relative a reverse direction becomes large. Such a check valve has no movable portion and can be produced by utilizing a method for manufacturing an integrated circuit or a printed wiring board or that for manufacturing a micromachine. The ink feed pump may be driven by the pulse motor.

When the ink feed pump driven by the pulse motor is provided, the ink feed pump may preferably be of a volumetric capacity type by which an ejection amount is proportional to a quantity of rotation of the motor. Suitable examples include a pump for squeezing a flexible tube appressed against the inner surface of a circular case on an inner peripheral side by an eccentric ring in a defined direction, a vane pump, a gear pump, and the like.

The ink feed pump disposed in each ink channel can be formed by the piezoelectric device and the check valve. In this case, the piezoelectric device is a diaphragm valve driven by a mechanical resonance frequency inherent to the device. When the pulse number (pulse number in a defined time or a unit time) of the driving frequency of each piezoelectric device is controlled, an ejection volume flow rate from each ink channel can be controlled.

The opening area of the ink channel of the image forming ink in the ink confluence portion is set to be smaller than that of the ink channel of the image non-forming ink. Therefore, an ink ejection length of the image forming ink increases, and the amount of the image forming ink advancing into the another ink increases. Therefore, the leading end of the image forming ink is easily cut, the density having fidelity to the image signal can be obtained, and the image quality is enhanced.

The flow rate (volume flow rate per unit time) of the image forming ink whose ejection amount is minimum is managed so as not to be constantly zero, and a mixture amount of this image forming ink can always be grasped and managed. In this case, since the natural diffusion of the image forming ink with respect to one pixel is considerably short, it is preferable to determine the flow rate required for refreshing the volumetric capacity by the diffusion as a minimum flow rate. As a result, a fluctuation in color and/or density due to natural diffusion of the ink can be suppressed, and a high-quality image can be formed.

In the present invention, the image formed on the image receiving medium includes graphical intelligence patterns such as alphanumeric characters, graphical display, line art, and other image information.

In another aspect of the present invention, there is provided an image forming method for ejecting a recording fluid constituted by a plurality of inks from a common ink ejection port while a mixing ratio of the plurality of inks is changed with respect to one pixel based on an image signal, and transporting the fluid to an image receiving medium which is moved with respect to the ink ejection port to form an image;

wherein said plurality of inks include an image non-forming ink which forms no image after dried out and at least one image forming ink which forms the image after dried out, an opening area Ai of a channel of said image forming ink is smaller than the opening area of the channel of said image non-forming ink in a confluence of said plurality of inks; and the opening area Ai of the channel of the image forming ink has the following relationship with a minimum ejection volume Vi of the image forming ink:

$$Ai \leqq 1.2 \times Vi^{(2/3)}.$$

DESCRIPTION OF THE PREFERRED EMBODIMENTS

First Embodiment

Figure 1:
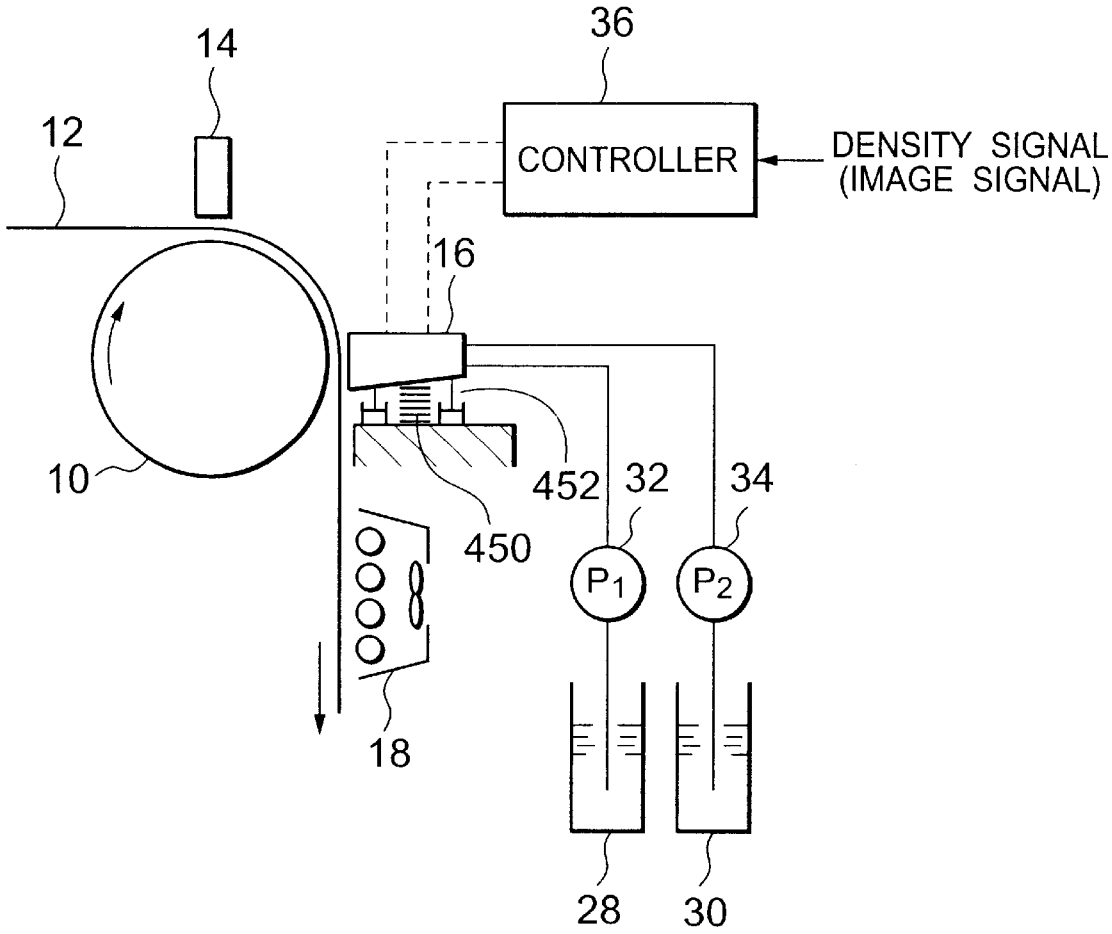
FIG. 1 is a view showing a concept of an image forming apparatus according to a first embodiment of the present invention to which a continuous coating mode is applied.

An image forming apparatus according to one embodiment of the present invention to which a continuous coating mode is applied will be described hereinafter with reference to FIGS. 1 and 2. In FIG. 1, reference numeral 10 designates a platen and 12 denotes a print paper as an image receiving medium wound around the platen 10. The print paper 12 is fed in a direction of an arrowhead at a fixed speed by clockwise rotation of the platen 10 as shown in FIG. 1.

Reference numeral 14 represents an undercoating section for applying a transparent undercoating liquid onto the print paper 12 in order to enhance the adherability of ink and improve an image quality. Reference numeral 16 denotes a recording head which serves as an image forming section for forming an image on the print paper 12. First ink and second ink are mixed or combined in the recording head and led to the print paper 12. Reference numeral 18 denotes a heater for heating the print paper 12 on which the image is formed by the image forming section 16 so that the ink is dried out.

Figure 2:
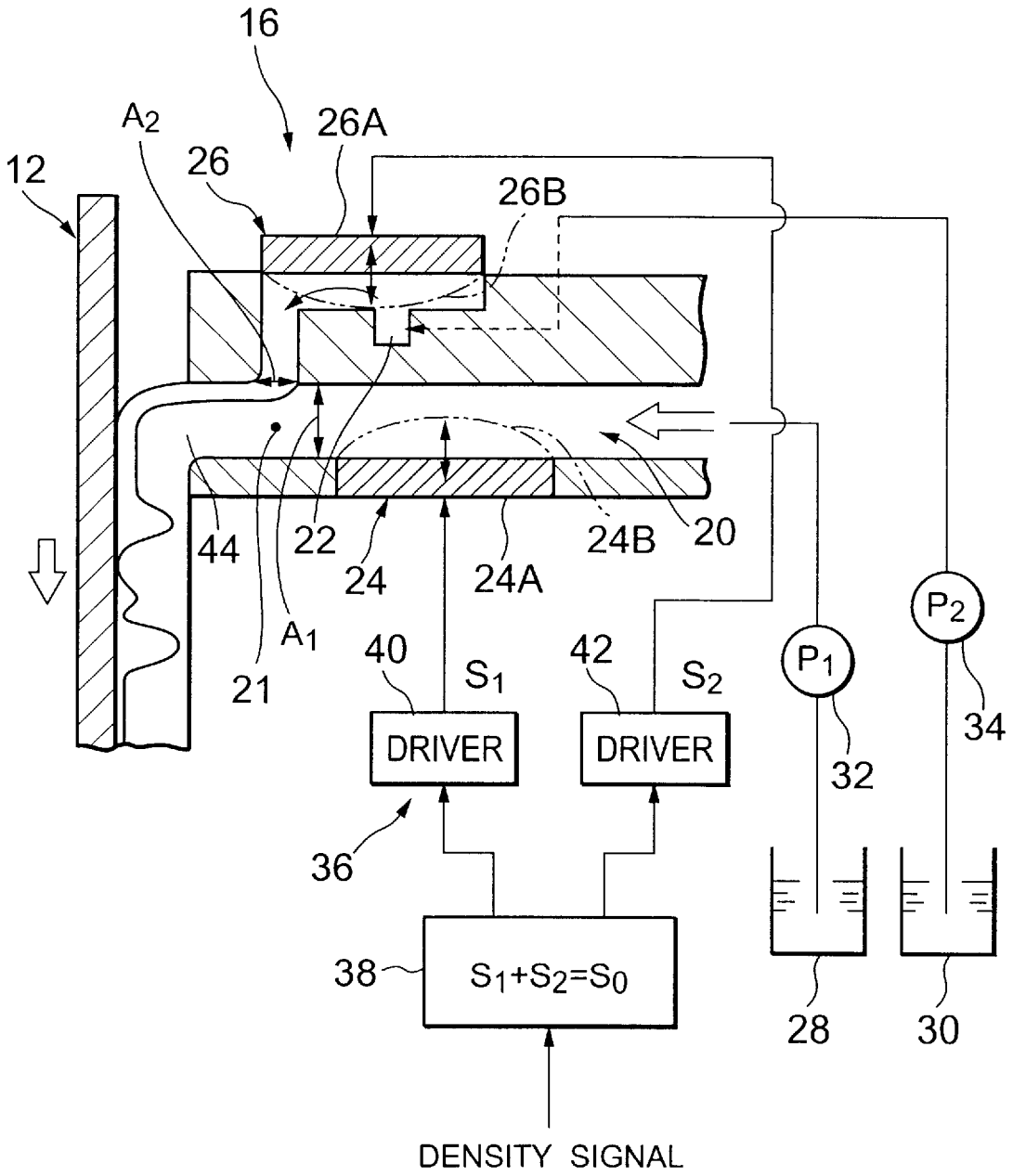
FIG. 2 is an enlarged sectional view of an image forming section (recording head) for use in the image forming apparatus of FIG. 1.

As shown in FIG. 2, the recording head 16 includes: a first ink channel 20; a second ink channel 22; and flow control valves 24 and 26 as ink flow rate controlling means for changing channel sectional areas of the respective channels 20 and 22. The first ink is an image non-forming ink (clear ink), that is, an ink which substantially forms no image when dried out. The first ink includes decoloration preventing agents such as antioxidant and ultraviolet ray absorber. The second ink is an image forming ink for substantially forming the image after dried out, for example, a black ink.

The first ink and second ink are respectively contained in ink tanks 28 and 30, and fed to the first and second ink channels 20 and 22 with a fixed pressure from the ink tanks 28 and 30 by ink feed pumps 32 and 34. As the pumps 32 and 34 used in this example, those having a structure in which a pressure adjusting valve is disposed on an ink discharge side (outlet port side of the pump) to maintain an ejection pressure constant are suitable.

The first ink channel 20 for supplying a clear ink and the second ink channel 22 for supplying a colored ink are set in such a manner that an opening area $A_1$ of the first ink channel 20 is larger than an opening area $A_2$ of the second ink channel 22 in a mixing section or confluence 21 of these channels. Therefore, a density having high fidelity to an image signal can be obtained by properly mixing the second ink (colored ink) with the first ink (clear ink), even if an ejection amount of the second ink is small.

More specifically, when the ejection amount of the second ink is reduced, and the ink channel area is not reduced, an ejection length of the ink becomes excessively small. Therefore, a flow of the second ink (colored ink) cannot smoothly be disconnected from the second ink channel at the mixing section (confluence with the first ink). The ejection amount of the second ink cannot be controlled in a small amount range. As a countermeasure, the opening area $A_2$ of the second ink channel is reduced so as to increase the ejection length of the second ink from the second ink channel to the confluence. Even if the ejection amount is small, a leading end of the second ink joins to and flows together with the first ink and is smoothly disconnected from the second ink channel.

For example, in a widely-used ink jet printer, an amount of ink used for forming one pixel is of the order of about 10 pL (pico-liter, $=10^{-12}$ L$=10^{-9}$ cm$^3$). In order to represent a density change, for example, of 100 tones with this amount, the amount of colored ink must be controlled by the order of 10 pL×(1/100)=0.1 pL. Assuming that the amount of 0.1 pL is perfectly ensphered, an ink droplet having a diameter of 5.8 $\mu$m (micrometer, $=10^{-3}$ mm) can be obtained.

It is assumed that a volume of the mixed first and second inks with respect to one pixel is 30 pL and a ratio of flow rate of the first ink (clear ink) is 99/100 and that of the second ink (colored ink) is 1/100.

A flow rate $V_1$ of the first ink (clear ink) and a flow rate $V_2$ of the second ink (colored ink) can be respectively expressed as follows:

$$V_1=29.7\text{ pL}=29.7\times10^{-12}\text{ L}=29.7\times10^{-6}\text{ mm}^3$$

$$V_2=0.3\text{ pL}=0.3\times10^{-6}\text{ mm}^3$$

Assuming that a section of the first ink channel 20 is a square having one side of 40 $\mu$m, the sectional area $A_1$ can be represented as $A_1=40\times40\times10^{-6}$ mm$^2=16\times10^{-4}$ mm$^2$. Therefore, a distance $x_1$ by which the first ink (clear ink) flows in the first ink channel 20 can be represented as follows:

$$x_1=V_1/A_1$$

$$=(29.7/16)\times10^{-2}\text{ mm}$$

$$=18.6\times10^{-3}\text{ mm}$$

$$=18.6\ \mu\text{m}$$

Here, it is presumed that the opening sectional area $A_2$ of the second ink channel 22 in the vicinity of the confluence 21 is equal to the sectional area $A_1$ of the first ink channel 20. That is, $A_2=A_1$ is assumed. A distance $x_2$ by which the second ink flows into the first ink channel 20 can be represented as follows.

$$x_2=V_2/A_2$$

$$=(0.3/16)\times10^{-2}\text{ mm}$$

$$=0.186\ \mu\text{m}$$

That is, a ratio of the moving amount $x_2$ of the second ink (colored ink) to the distance $x_1$ of the first ink (clear ink) becomes 1/100.

In this case, the second ink flows into the first ink channel 20 only by the moving amount $x_2$. However, since this moving amount, that is, an ingress amount $x_2$ is extremely small, the second ink cannot overcome the surface tension thereof and is not discharged into the first ink. At this time, the leading end of the second ink just slightly moves into or from the first ink channel 20, and the first ink is not mixed with the second ink. That is, the leading end of the second ink cannot smoothly be disconnected.

As a countermeasure, a front edge of the second ink channel 22, that is, a portion (opening area $A_2$) in which the second ink channel 22 becomes confluent with the first ink channel 20 is formed to have a nozzle-like shape having a small diameter. This increases the ingress amount of the second ink into the first ink channel 20 to improve disconnection of the second ink. Thereby, an extremely small amount of the second ink can be controlled.

For example, the opening of area $A_2$ of the second ink channel 22 open to the confluence 21 can be determined as follows. To simplify the description, the opening has a circular shape with a radius R. Assuming that a minimum ejection volume of the second ink is Vi, half of ink particles need to be ejected toward the confluence from a nozzle in order to disconnect the ink particles having the minimum ejection volume Vi toward the confluence 21 from the ink channel 22. That is, the radius of the ink particle needs to agree with an opening radius of the second ink channel.

Assuming that the opening area $A_2=\pi R^2$, and the ink particle is a sphere having the radius R, the minimum ejection volume Vi is $Vi=(4/3)\pi R^3$, and the opening area $A_2$ can therefore be represented as follows.

$$Ai(=A_2)=(3/4)^{(2/3)}\times\pi^{1/3}\times Vi^{(2/3)}=1.21\times Vi^{(2/3)}$$

Therefore, when $$A_2\leqq1.2\times Vi^{(2/3)}$$

the ink particle of the second ink having the minimum ejection volume Vi projects from the opening in a sharper shape rather than a spherical shape, and can smoothly be disconnected toward the confluence. As a result, the excessive small amount of the second ink can be controlled.

Flow control valves 24, 26 include, for example, piezoelectric devices 24A, 26A and diaphragms 24B, 26B which move into/from the ink channels 20, 22 by distortions of the devices 24A, 26A, respectively. For these piezoelectric devices 24A, 26A, supply amounts $S_1$ and $S_2$ of the first and second inks supplied from the respective ink channels 20 and 22 are controlled by a controller 36 (FIG. 1).

The controller 36 includes a processor 38 and drivers 40, 42 as shown in FIG. 2. The processor 38 calculates a mixing ratio ($S_1/S_2$) of the first and second inks based on a density signal (image signal). Here, the supply amount $S_2$ of the second black ink is constantly controlled so as not to be zero. Additionally, the supply amounts $S_1$ and $S_2$ of the first and second inks are determined so that a sum ($S_1+S_2$) becomes a fixed amount $S_0$. Therefore, the flow of an ink fluid is stabilized, a turbulence or a whirlpool is not generated as described later, and stable formation of the image is enabled. The drivers 40 and 42 drive the piezoelectric devices 24A and 26A in order that the supply amounts from the respective channels 20 and 22 become $S_1$ and $S_2$.

For example, the piezoelectric devices 24A and 26A are driven by a pulse having a mechanical resonance frequency inherent to the device, and the pulse number controls a number of times of opening/closing the diaphragms 24B and 26B, thereby controlling flow rate $S_1$ and $S_2$. In this case, if the channel resistance of the ink channels 20, 22, ink feed pressure, condition for opening/closing the diaphragms 24B, 26B, and the like are satisfied, a total flow rate $S_0=S_1+S_2$ can be managed to be constant by controlling a sum of the pulse number for driving the piezoelectric devices 24A, 26A to indicate a fixed value.

A minimum supply amount $S_{20}$ of the second ink supply amount $S_2$ is set in such a manner that a change in optical density of the ink liquid due to addition of this ink becomes not more than 0.1, for example. In this case, the density change of all-white portion (background portion, and the like) in the image can be suppressed to such an extent that the change can hardly be identified visually. Incidentally, even in case of all white, a density tone is corrected in the processor 38 of the controller 36 in accordance with addition of a small amount (minimum supply amount) $S_{20}$ of the second ink supply amount $S_2$ if necessary.

The first and second inks whose flow rates are controlled are ejected as a continuous flow from an ink ejection port 44 in which the first and second channels 20 and 22 become confluent, and continuously applied onto the print paper 12 opposite to the ink ejection port 44. In this case, the first and second inks are applied as a layer or laminar flow having no turbulence without being mixed with each other as shown in FIG. 2. Here, the layer flow includes a flow which is mixed only in the vicinity of a border between the first and second inks. Although the first and second inks may uniformly be mixed, the surface of the image formed on the print paper 12 can be covered with any ink (the first ink in this example) by providing the layer flow in this manner. When any ink (the second ink in this example) is an ink having conformability to an undercoating layer of the print paper 12, the image quality can be improved.

When a large number of sets of the first and second ink channels 20, 22 and flow control valves 24, 26 are provided to be aligned in a width direction of the print paper (direction perpendicular to the moving direction of the print paper), and are disposed for the respective pixels, the image can be formed by controlling the flow control valves 24, 26 for the respective pixels based on the density signal (image signal). In this case, the ink ejection port 44 can independently be disposed to face the print paper 12 for each pixel. Further, these ink ejection ports 44 can be formed in the slot-shaped openings elongated in the width direction of the print paper 12, and the ink liquid constituted by the first and second inks can be transported and applied onto the print paper 12 from this slot opening in a band shape.

Second Embodiment

Figure 3:
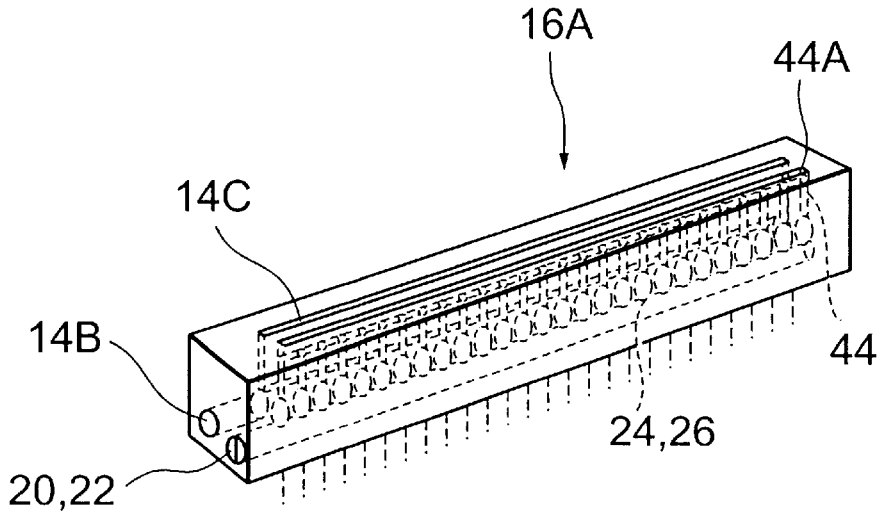
FIG. 3 is a perspective view showing an image forming section (recording head) for zonally transporting an ink to print paper according to a second embodiment of the present invention.

FIG. 3 is a perspective view showing an image forming section (recording head) 16A for use in a second embodiment for performing continuous zonal application as described above, and FIG. 4 is an enlarged sectional view showing the state of application. The recording head 16A includes ink ejection ports 44 which are independent for the respective pixels and a slot opening 44A which is disposed in parallel with the ink ejection ports 44 for the respective pixels. The ink liquid continuously ejected from each ink ejection port 44 congregates in the band shape as the layer flow in the slot opening 44A, and is ejected or extruded onto the print paper 12.

An undercoating section 14A is integrally incorporated in the recording head 16A. The undercoating section 14A includes an undercoating liquid channel 14B which is disposed in parallel to the first and second ink channels 20, 22 and a slot opening 14C which is disposed in parallel to the slot 44A. Here, the opening areas $A_1$, $A_2$ in the confluence (mixing section) 21 of the first and second ink channels 20, 22 have a relation $A_1>A_2$. Since an undercoating liquid L is transparent and colorless and used in a preliminary treatment for stably attaching the ink liquid to the surface of the print paper 12, the undercoating liquid is positioned on the upstream side of the slot 44A of the recording head 16A with respect to the moving direction of the print paper 12.

Figure 4:
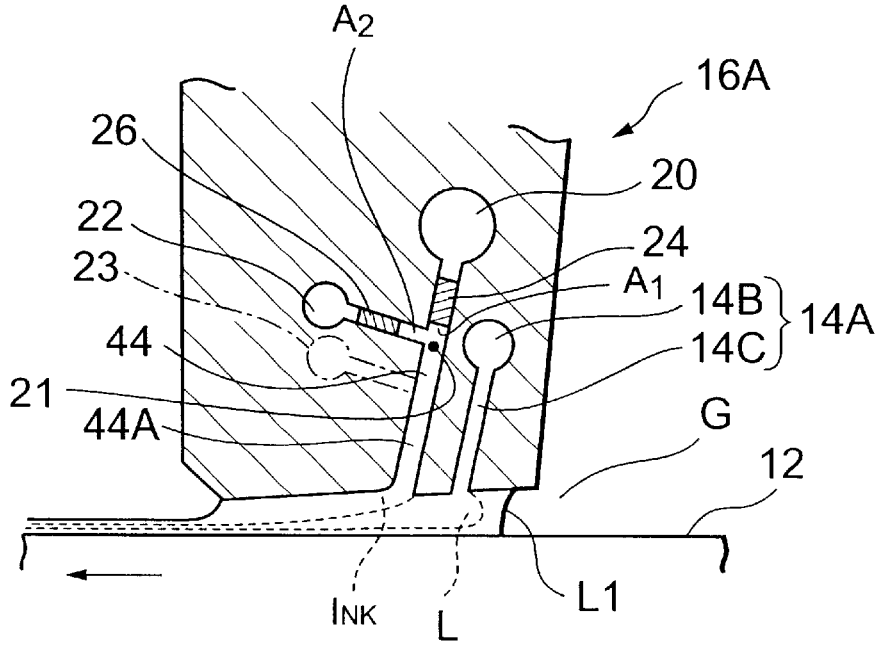
FIG. 4 is an enlarged sectional view showing a state of coating applied by a recording head of FIG. 3.

The undercoating liquid L also has a function of preventing turbulence or whirlpool from being generated in the flow of an ink liquid $I_{NK}$ during continuous application of the ink liquid $I_{NK}$ and improving the image quality. Specifically, as shown in FIG. 4, a part of the undercoating liquid L which has been just ejected from the slot 14C flows to the upstream side of the slot 14C to form a liquid pool L1 in a gap G formed between the recording head 16A and the print paper 12. The whirlpool of the undercoating liquid L may be generated in the liquid pool L1, but this does not adversely affect a coating surface because the undercoating liquid L is transparent.

The undercoating liquid L comes in front of the slot 44A as a stable layer flow having a fixed thickness with movement of the print paper 12. Accordingly, the ink liquid $I_{NK}$ ejected from the slit 44A is loaded onto the stable layer flow of the undercoating liquid L to be applied. Therefore, the image quality can be improved without generating distortion or whirlpool in the flow of the ink liquid $I_{NK}$.

A third ink channel 23 may be provided in the recording head 16A. A third ink supplied from the third ink channel 23 is led to the ink ejection port 44 through the flow control valve (not shown) and transported to the print paper 12 together with the first and second inks. When the third ink channel 23 is disposed, inks having colors of yellow, magenta and cyan is supplied to the first, second and third ink channels 20, 22 and 23, respectively, and a mixing ratio of the color inks is varied, thus enabling formation of a color image.

Third Embodiment

Figure 5:
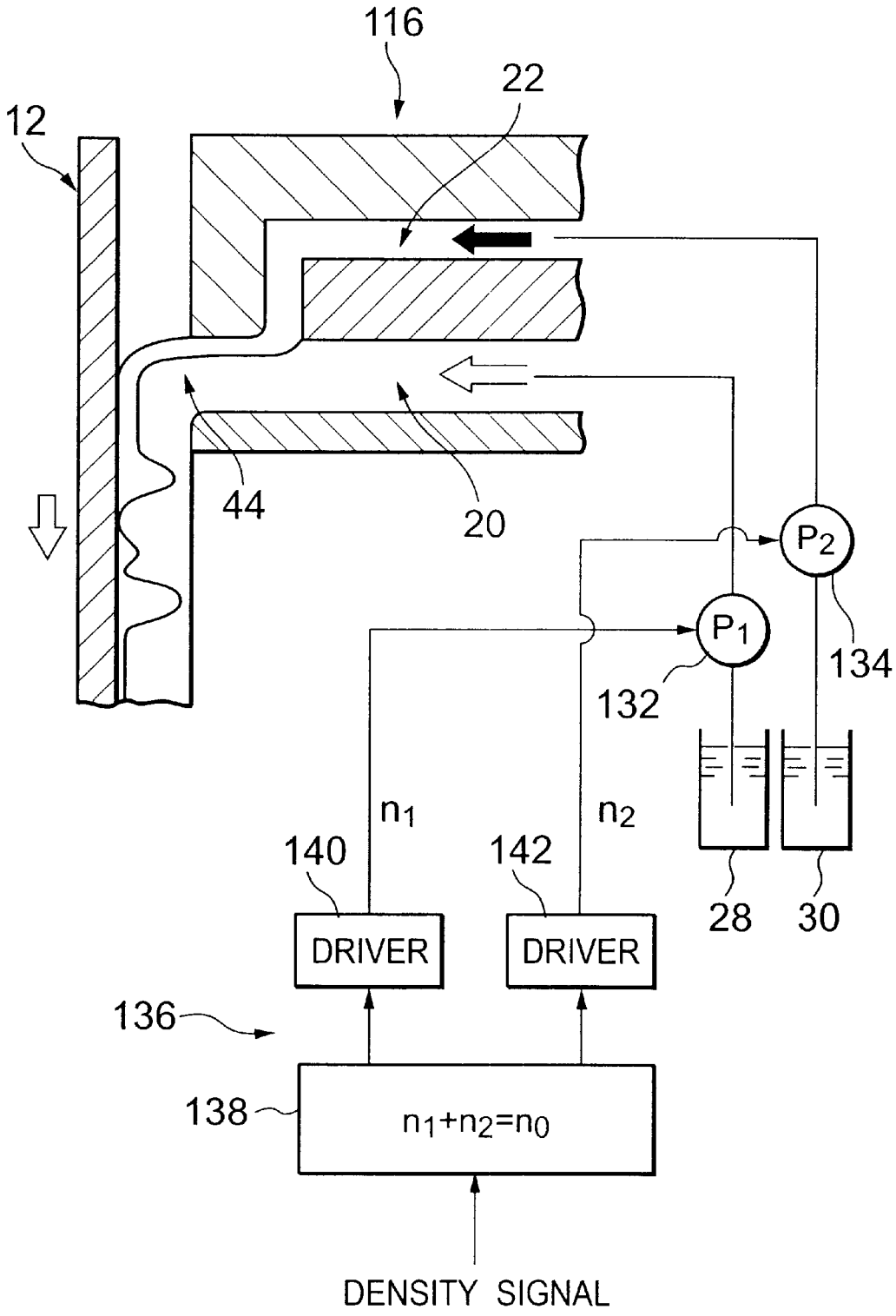
FIG. 5 is a sectional view showing an image forming section (recording head) according to a third embodiment.

FIG. 5 is a sectional view showing an image forming section (recording head) 116 according to a third embodiment. In the recording head 116, the flow rate of ink supplied to the first and second ink channels 20, 22 is controlled by changing discharge quantity of ink feed pumps 132, 134, instead of using the flow control valves 24, 26 described with reference to FIGS. 1 to 4.

The pumps 132, 134 are of a volumetric capacity type having the discharged quantity which is proportional to a rotation amount. For example, a pump for squeezing a flexible tube appressed against the inner surface of a circular case from the inner peripheral side by an eccentric ring in a defined direction is suitable. The pumps 132, 134 are driven by a pulse motor (stepping motor). The rotation amount of this motor can be controlled by a driving pulse number and, as a result, the discharged amount of the ink from the pumps 132, 134 can be controlled.

A controller 136 is formed of a processor 138 and drivers 140, 142. The processor 138 determines a mixing ratio of the first and second inks based on the density signal (image signal) and calculates pulse numbers $n_1$ and $n_2$ to be fed to the motors of the respective pumps 132, 134 in accordance with the mixing ratio. The drivers 140, 142 send driving pulses having pulse numbers $n_1$, $n_2$ to the respective motors to actuate the pumps 132, 134. Consequently, predetermined amounts of the first and second inks are supplied to the first and second ink channels 20, 22, and are transferred as a fixed flow rate of the ink liquid from the ink ejection port 44 to the print paper 12. In this case, the sum of amounts of ejected ink is adjusted to be always constant in such manner that $n_1+n_2$ becomes a fixed value $n_0$.

Fourth Embodiment

Figure 6:
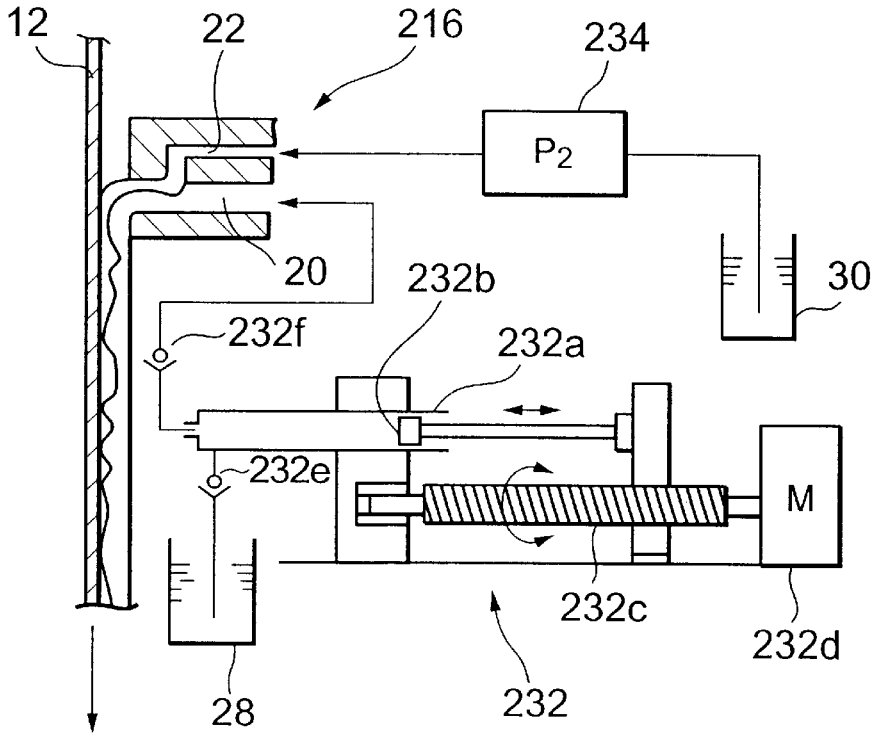
FIG. 6 is a sectional view showing an image forming section (recording head) according to a fourth embodiment.

FIG. 6 is a sectional view showing an image forming section (recording head) 216 according to a fourth embodiment. In this embodiment, ink feed pumps 232, 234 for feeding the first and second inks are used instead of the flow rate control valves 24, 26 of FIGS. 1 to 4. The pump 232, 234 are formed by cylinder pump. Since the pumps 232, 234 have the same structure, only one pump 232 will be described.

The cylinder pump 232 includes a cylinder 232*a*, a piston 232*b*, a feed screw 232*c* for pushing/pulling the piston 232*b*, and a pulse motor 232*d* for driving to rotate the feed screw 232*c*. The piston 232*b* is pushed and pulled in the cylinder 232*a* by the normal/reverse rotation of the motor 232*d*. The first ink is sucked in the cylinder 232*a* from the ink tank 28 through a one-way valve 232*e* with the movement of the piston 232*b*, and the ink is fed into the first ink channel 20 through one-way valve 232*f* with the movement of the piston 232*b*.

A quantity of movement of the piston 232*b* is proportional to a quantity of rotation of the motor 232*d*. Therefore, the piston 232*b* is fully moved in a retreating direction of recession before forming one page of image, and the first ink is sufficiently sucked in the cylinder 232*a*. Thereafter, the motor 232*d* is rotated by a quantity of rotation corresponding to the density signal to move the piston 232*b* in a direction of ingress only by a predetermined quantity of movement, thereby feeding out a predetermined amount of the first ink to the ink channel 20. The motor 232*d* can be driven by a controller 136 similar to that in the embodiment shown in FIG. 5.

Fifth Embodiment

Figure 7:
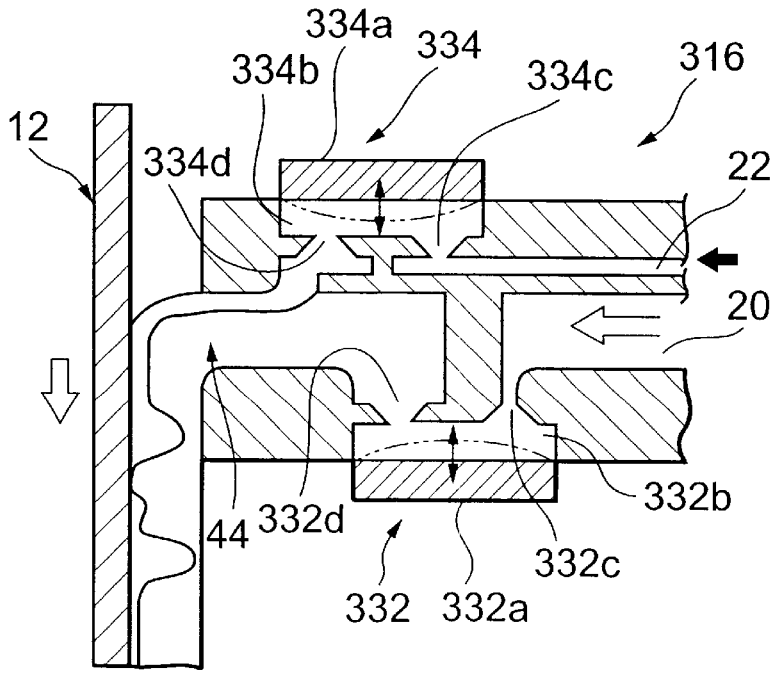
FIG. 7 is a sectional view showing an image forming section (recording head) according to a fifth embodiment.

FIG. 7 is a sectional view showing an image forming section 316 (recording head) according to a fifth embodiment. In this embodiment, ink feed pumps 332, 334 using the piezoelectric devices are used instead of the ink feed pumps 132, 134 in FIG. 5 and 232, 234 in FIG. 6. The pumps 332, 334 include: piezoelectric devices 332*a*, 334*a*; cavities 332*b*, 334*b* using each of the piezoelectric devices 332*a*, 334*a* as one wall surface; inlets 332*c*, 334*c* having such a shape as that conductance (inverse number of the resistance) varies with respect to the cavities 332*b*, 334*b* in accordance with a flow direction of the ink; and outlets 332*d*, 334*d*, respectively. Here, any surface treatment is preferably applied or a protection layer is provided on the surfaces of the piezoelectric devices 332*a*, 334*a* with which the cavities 332*b*, 334*b* come into contact.

Accordingly, when the piezoelectric devices 332*a*, 334*a* are driven and deformed, volumetric capacities of the cavities 332*b,* 334*b* vary, and the ink flows from the inlets 332*c,* 334*c* toward the outlets 332*d,* 334*d.* The piezoelectric devices 332*a,* 334*a* are driven by a pulse voltage having a mechanical resonance frequency for each device. Therefore, when the pulse number for driving the piezoelectric devices 332*a* and 334*a* is controlled, the supply amounts of the first and second inks can be controlled. In this case, a controller similar to the controller 36 shown in FIG. 2 can be used.

Sixth to Tenth Embodiments

Figure 8:
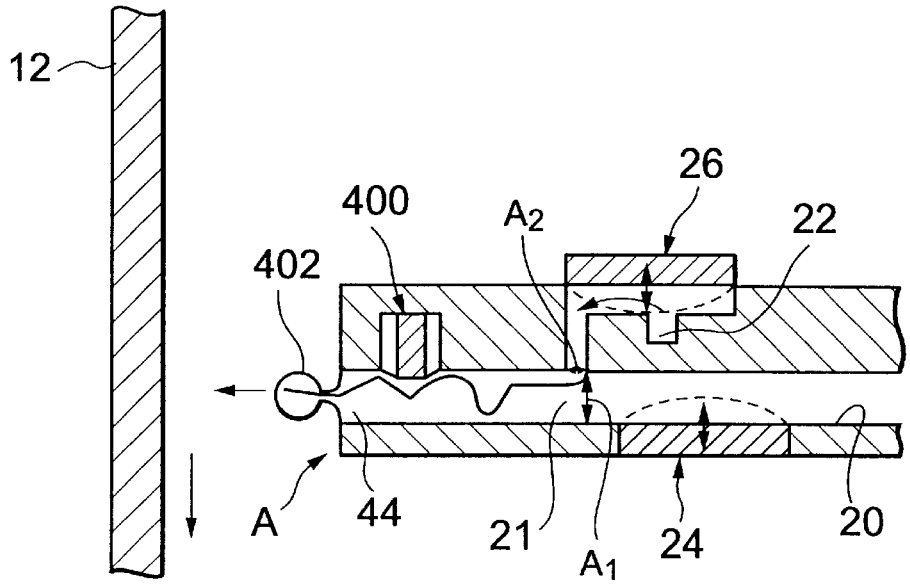
FIG. 8 is a sectional view showing an image forming section (recording head) according to a sixth embodiment having ink transporting means to which a piezo ink jet mode is applied.
Figure 9:
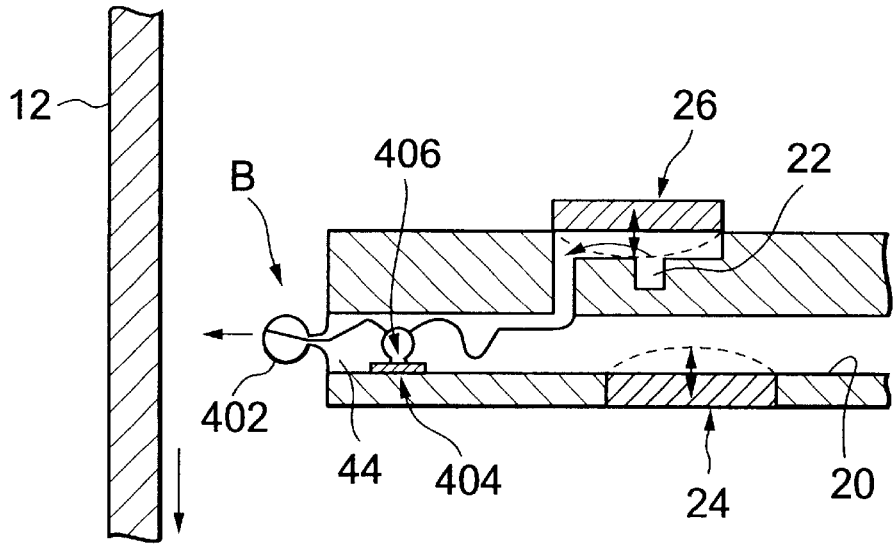
FIG. 9 is a sectional view showing an image forming section (recording head) according to a seventh embodiment having the ink transporting means to which a thermal ink jet mode is applied.
Figure 10:
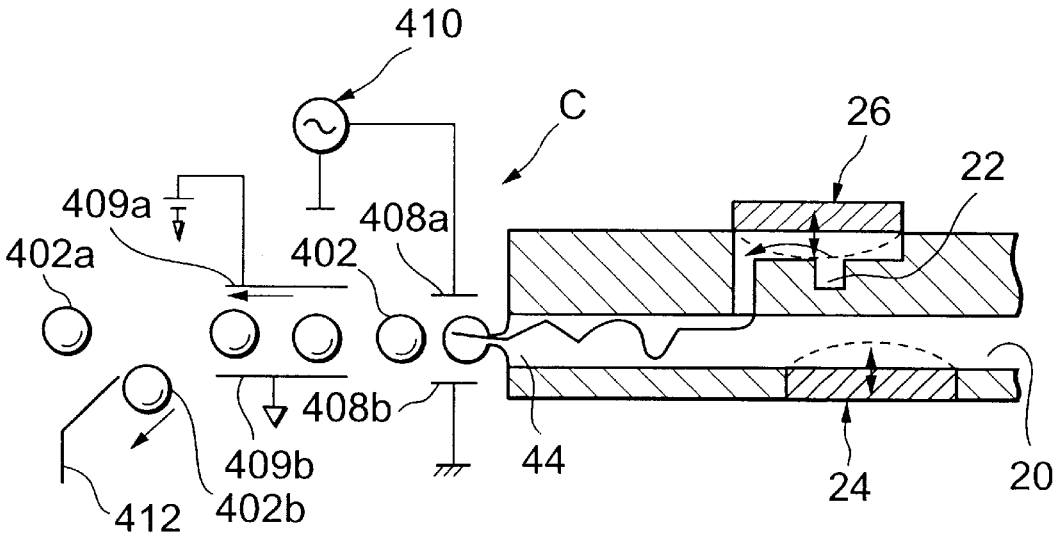
FIG. 10 is a sectional view showing an image forming section (recording head) according to an eighth embodiment having ink transporting means to which a continuous ink jet mode is applied.
Figure 11:
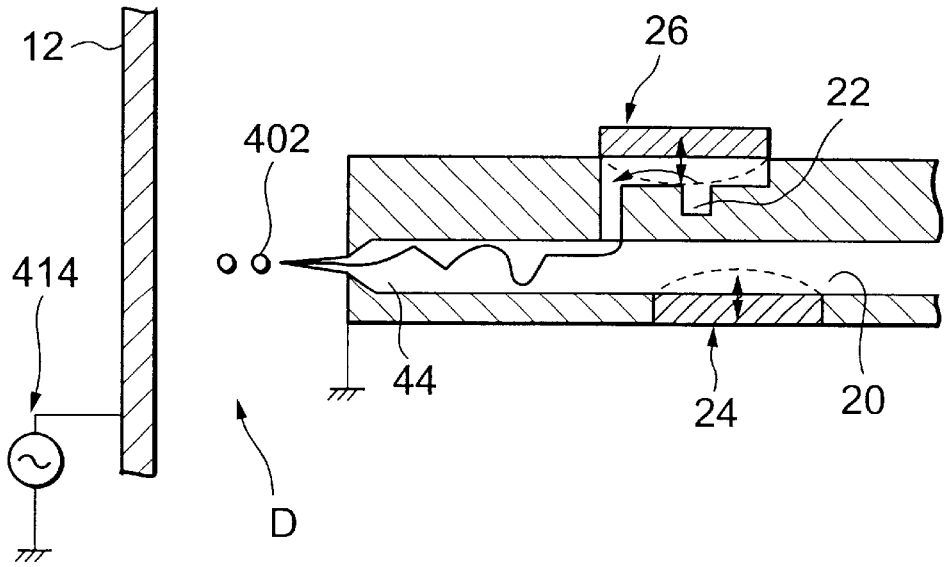
FIG. 11 is a sectional view showing an image forming section (recording head) according to a ninth embodiment having the ink transporting means to which an electrostatic attraction ink jet mode is applied.
Figure 12:
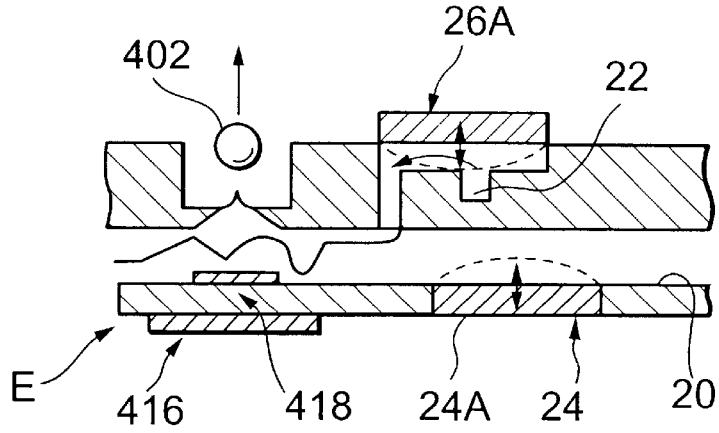
FIG. 12 is a sectional view showing an image forming section (recording head) according to a tenth embodiment having the ink transporting means to which an ultrasonic ink jet mode is applied.

FIGS. 8 to 12 show each image forming section having ink transporting means according to sixth to tenth embodiments, respectively. FIG. 8 shows a piezo ink jet mode; FIG. 9, a thermal ink jet mode; FIG. 10, a continuous ink jet mode; FIG. 11, an electrostatic attraction ink jet mode; and FIG. 12, an ultrasonic ink jet mode.

In these embodiments, the first and second inks controlled by the flow control valves 24, 26 using the piezoelectric devices 24A, 26A, respectively, similar to those shown in FIG. 2 are led to the ink ejection port 44. Moreover, the opening areas $A_1$, $A_2$ of the first and second ink channels 20, 22 in the confluence (mixing section) 21 have a relation of $A_1>A_2$. The ink transporting means A in FIG. 8 ejects the ink as a droplet 402 by using an ejecting piezoelectric device 400 disposed in the vicinity of the ink ejection port 44, and leads the droplet onto the print paper 12.

The ink transporting means B in FIG. 9 generates a bubble 406 by heating the ink liquid by a heater 404 disposed in the vicinity of the ink ejection port 44 in order to eject or jet an ink droplet 402. In ink transporting means C of FIG. 10, a high voltage in accordance with the image signal is applied between electrodes 408 (408*a,* 408*b*) disposed before the ink ejection port 44 by an oscillator 410. As a result, an electric charge in accordance with the image signal is imparted to the ink droplet 402 drawn from the ink ejection port 44. The ink droplet is deflected by deflecting electrodes 409 (409*a,* 409*b*) so that only a necessary droplet 402*a* is led to the print paper 12 while removing an unnecessary droplet 402*b* by a baffle plate 412.

Ink transporting means D of FIG. 11 narrows down the ink ejection port 44 to a small diameter and applies a direct-current high voltage associated with the image signal between the ink ejection port 44 and the print paper 12 by an oscillator 414. The high voltage is used to draw the ink droplet 402 from the ink ejection port 44 so that the ink droplet 402 is attracted onto the print paper 12. In ink transporting means E of FIG. 12, an ultrasonic transducer 416 is disposed on an outer wall of the ink ejection port 44, and an ultrasonic wave emitted from the ultrasonic transducer 416 is converged on the ink liquid by a Fresnel lens 418 disposed on the inner wall of the ink ejection port 44 to excite the ink liquid so that the droplet 402 is generated.

When the inks are mixed with one another by natural diffusion between the inks in the confluence of a plurality of inks, and a vibration occurs in the confluence, or vibration or turbulence is generated in the ink flow, the turbulence is produced on a contact interface of the inks due to these disturbances, thereby facilitating mixture of the inks. Therefore, a minimum addition amount of the ink which is not transparent or colorless must be increased, and this may result in restriction of the density tone or degradation of the image quality.

Thus, it is preferable to provide a vibration absorption mechanism in the confluence of the inks. For example, the image forming section (recording head) 16 can be supported by an antivibration spring 450 or an attenuator 452 as shown in FIG. 1. Moreover, in order to suppress the pulse of the ink or the vibration of the flow control valves 24, 26, it is preferable to additionally dispose a damper for absorbing the ink pulses or to adopt the flow control valves 24 and 26 which are of a vibration absorbing type.

In the first to tenth embodiments described with reference to FIGS. 1 to 12, since two types of ink are mixed or combined and one of them is used as the image non-forming ink, the image can be formed by changing the density. However, in the present invention, the color and density can simultaneously be changed by mixing two or more types of ink having colors of, for example, yellow, magenta, cyan and black or mixing these types of ink with the image non-forming ink. Instead of using the image forming section 16 for forming the image directly on the image receiving medium such as the print paper 12, the image may be formed temporarily on an intermediate image receiving medium such as an intermediate transfer drum, so that the image can be transferred from the intermediate image receiving medium to a final image receiving medium such as the print paper.

Eleventh Embodiment

Figure 13:
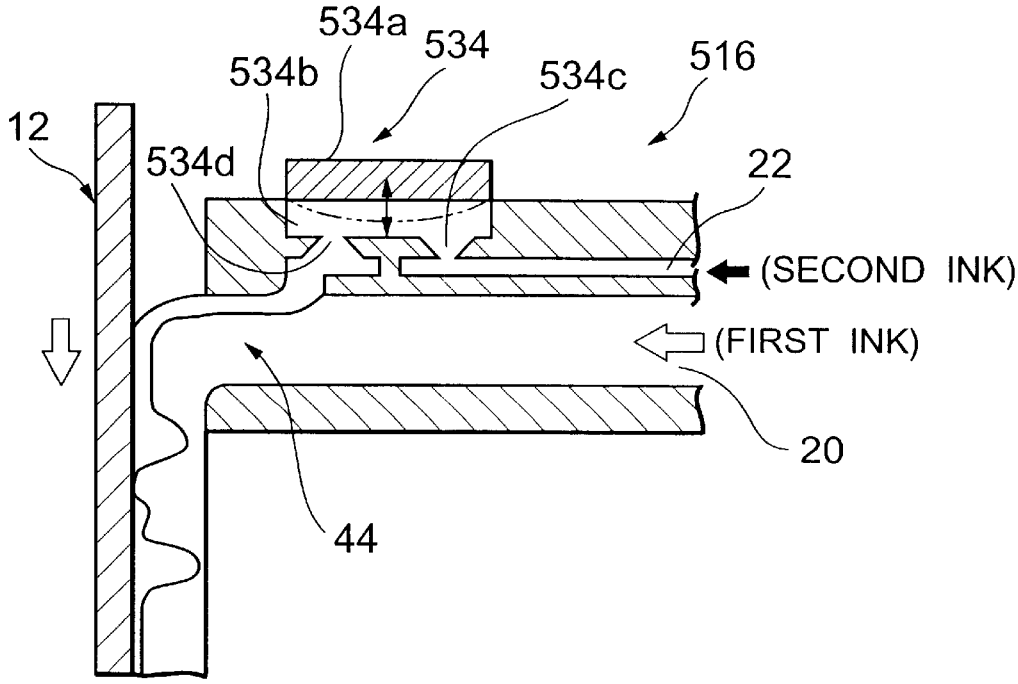
FIG. 13 is a sectional view showing an image forming section (recording head) according to an eleventh embodiment to which a continuous coating mode is applied.

FIG. 13 is a sectional view showing an image forming section (recording head) 516 according to an eleventh embodiment adopting a continuous coating mode. This embodiment employs an ink feed pump 534 driven by the piezoelectric device, instead of the ink feed pump 234 formed by the cylinder pump in the recording head 216 shown in FIG. 6.

This ink feed pump 534 is constituted similarly as the ink feed pump 334 shown in FIG. 7. That is, a cavity 534*b,* and check valves 534*c* and 534*d* which are positioned before and after the cavity 534*b* are disposed in the second ink channel 22, and a diaphragm which is driven by a piezoelectric device 534*a* or a diaphragm which is integral with the piezoelectric device 534*a* is used to change a volumetric capacity of the cavity 534*b.*

Twelfth Embodiment

Figure 14:
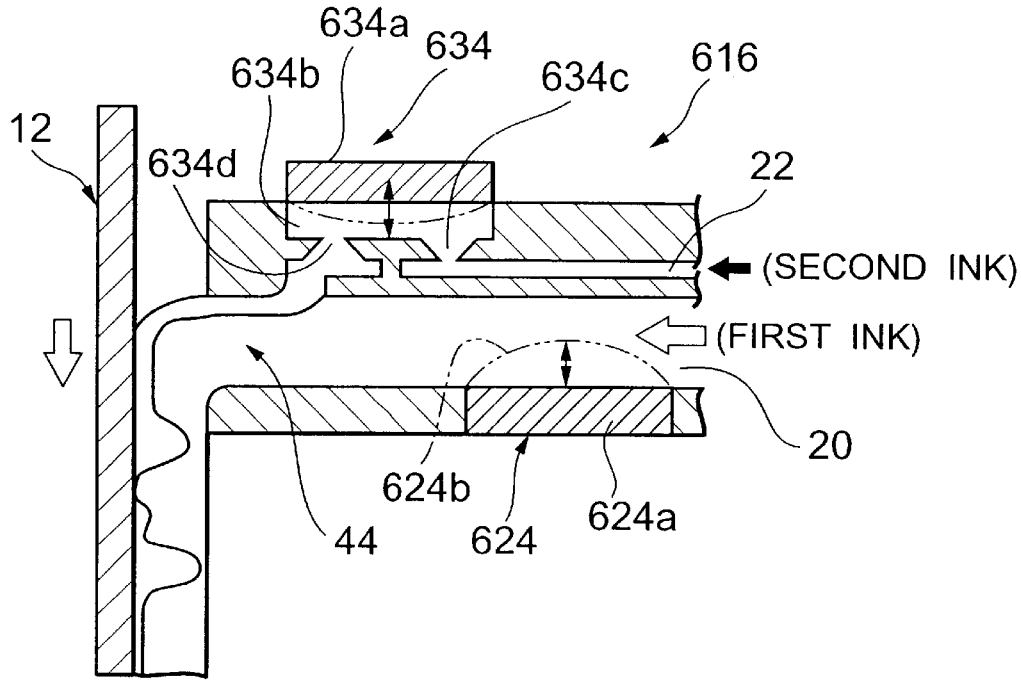
FIG. 14 is a sectional view showing an image forming section (recording head) according to a twelfth embodiment to which the continuous coating mode is applied.

FIG. 14 is a sectional view showing an image forming section (recording head) 616 according to a twelfth embodiment similarly adopting the continuous coating mode. This embodiment uses an ink feed pump 634 instead of the flow control valve 26 in the recording head 16 shown in FIG. 2.

The first ink is supplied to the first ink channel 20 with a fixed pressure by a pump (not shown), and the flow rate of the first ink is controlled by a flow control valve 624 disposed in the first ink channel 20. An effective sectional area of the ink channel in the flow control valve 624 is controlled by displacement of a diaphragm 624*b* driven by a piezoelectric device 624*a.* An ink feed pump 634 disposed in the second ink channel 22 has a piezoelectric device 634*a,* a cavity 634*b,* and check valves 634*c,* 634*d.*

Thirteenth Embodiment

Figure 15:
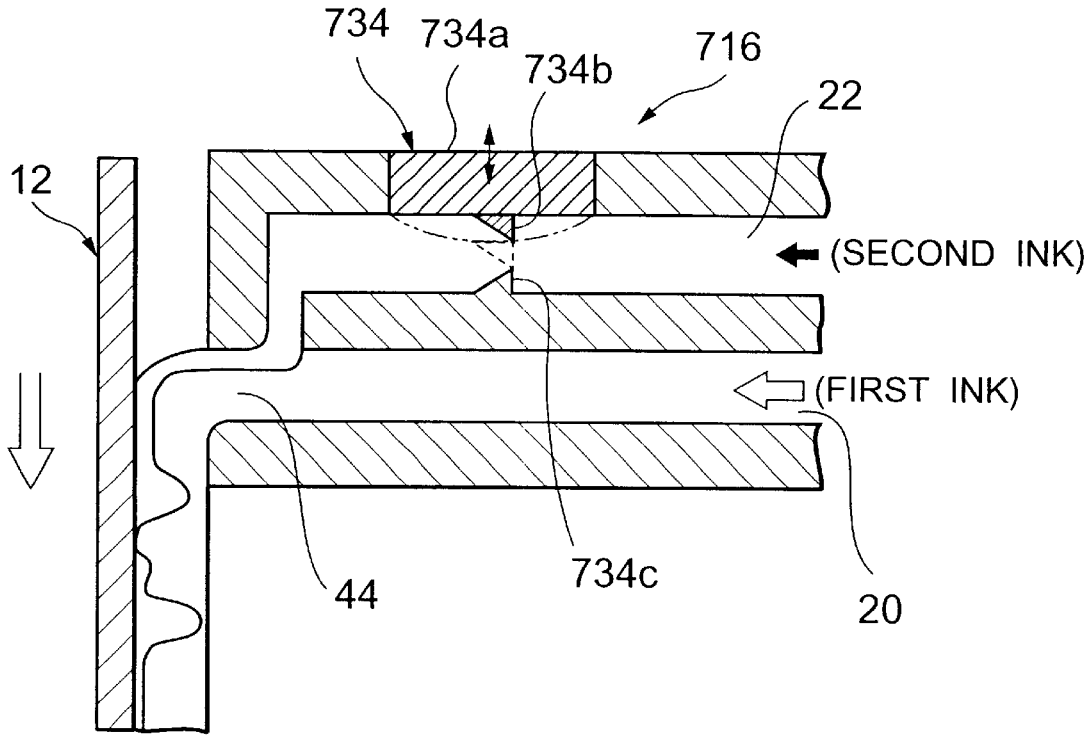
FIG. 15 is a sectional view showing an image forming section (recording head) according to a thirteenth embodiment to which the continuous coating mode is applied.

FIG. 15 is a sectional view showing an image forming section (recording head) 716 according to a thirteenth embodiment similarly adopting the continuous coating mode. In this embodiment, an ink feed pump 734 is used instead of the ink feed pump 234 formed by the cylinder pump in the image forming section 216 shown in FIG. 6.

The ink feed pump 734 includes a piezoelectric device 734*a* facing the second ink channel 22, and a pair of wedge-shaped protrusions 734*b,* 734*c* disposed opposite to each other. The protrusion 734*b* is disposed on the piezoelectric device 734*a,* and the other protrusion 734*c* is disposed on an inner wall of the ink channel 22 opposite to the piezoelectric device 734*a*. The protrusions 734*b,* 734*c* have inclined surfaces extending toward an ink flow direction from each other. The vibration of the piezoelectric device 734*a* allows the protrusion 734*b* to move forward/backward in the ink channel 22. Consequently, the ink sandwiched between the inclined surfaces of the protrusions 734*b,* 734*c* is pushed out in a direction of the ink ejection port 44. Therefore, the ejection amount of the second ink is controlled by a number of vibrations and an amplitude of the piezoelectric device 734*a*.

Structure of Check Valve

Figure 16:
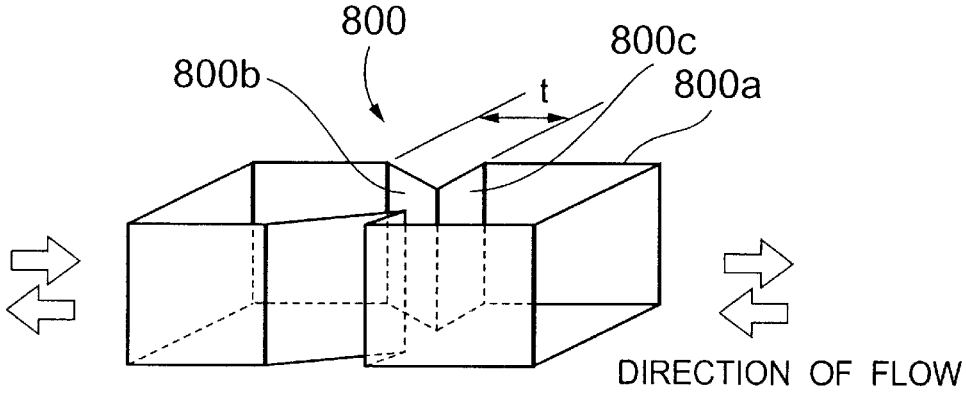
FIGS. 16 to 18 are perspective views showing various structures of a check valve for use in ink feed pumps 334, 434 and 634 shown in FIGS. 7, 13 and 14.
Figure 17:
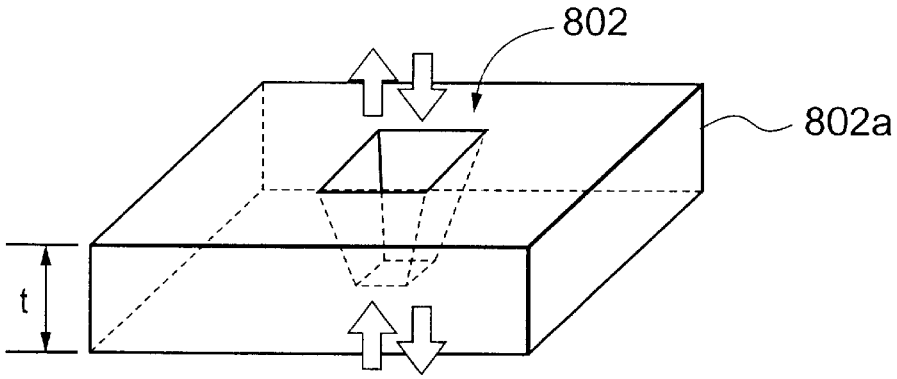
Figure 18:
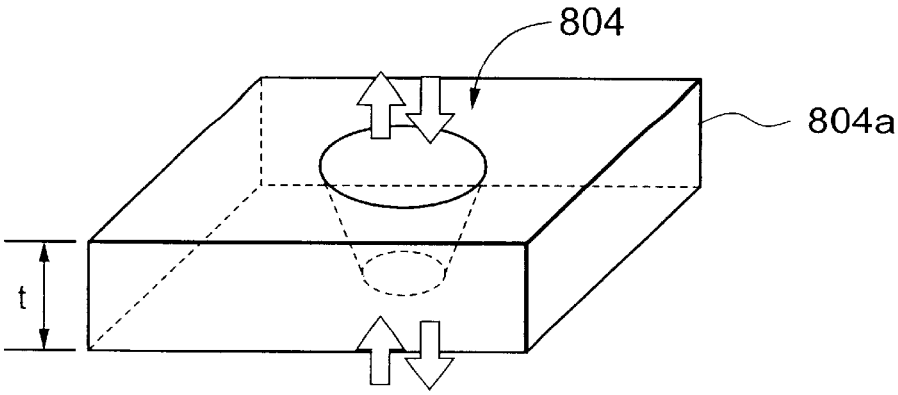

FIGS. 16, 17 and 18 are perspective views showing different structures of a check valve, and FIG. 19 is detailed explanatory drawings of these structures. Check valves 800, 802 and 804 shown in the drawings are used in the ink feed pumps 334 (FIG. 7), 534 (FIG. 13) and 634 (FIG. 14) shown in FIGS. 7, 13 and 14. Each of these check valves 800, 802 and 804 is a restriction or restrictor having a geometrical shape such that the resistance with respect to the ink flow direction becomes larger than the resistance with respect to the reverse direction. Therefore, each check valve has no movable portion and can readily be produced by a method for manufacturing a micro-machine.

The check valve 800 shown in FIG. 16 has a substrate 800*a,* an inclined surface 800*b* whose ink channel sectional area substantially-continuously increases from the right side toward the left side of the substrate 800*a,* and a flat surface 800*c* whose ink channel sectional area rapidly increases in the reverse direction.

When a cavity having a fluctuating volumetric capacity is disposed in the vicinity of the check valve 800, the ink reciprocates through the check valve 800 by a fluctuation in the volumetric capacity of the cavity. In such a case, the resistance decreases when the ink flows toward the left-hand-side direction in FIG. 16, and the resistance increases when the ink flows toward the reverse direction (the right-hand-side direction). Therefore, the fluctuation in the volumetric capacity of the cavity causes the ink to flow in a direction in which the resistance decreases (the left-hand-side direction in the drawing), and the cavity functions as the check valve.

The check valve 802 shown in FIG. 17 uses a quadrangular-pyramid-shaped restriction formed on a substrate 802*a*. The check valve 804 shown in FIG. 18 uses a conical aperture restriction formed on a substrate 804*a*. These check valves 802 and 804 also function similarly as the check valve 800 shown in FIG. 16.

Figure 19A:
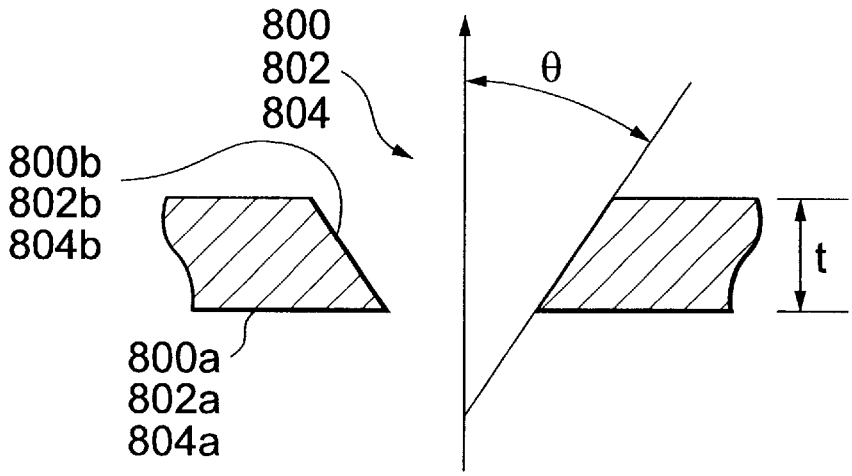
FIG. 19A is an explanatory view showing a detailed structure of the check valve shown in FIGS. 16 to 18.

These check valves 800, 802 and 804 have a detailed structure shown in FIG. 19. In FIG. 19A, an inclination θ of an inclined surface 800*b* of the check valve 800 should be appropriately determined in accordance with a relationship to a length t of a component (hereinafter referred to simply as a thickness) with respect to the ink flow direction on the inclined surface 800*b* of the substrate 800*a*. Also, the inclinations θ of pyramidal and conical surfaces 802*b* and 804*b* of the check valves 802 and 804 are determined in accordance with the relationship to thicknesses t of 802*a* and 804*a,* respectively.

According to the experiment, a flow resistance of fluid to the upward direction in FIG. 19A is smaller than the flow resistance to the downward direction when the inclination θ is set in a range of $2°<\theta<15°$, and the fluid flows upwards. Further, it was found that conversely the upward flow resistance is larger than the downward flow resistance when the inclination θ in a range of $20°<\theta<70°$, and the fluid flows downwards. When the flowing direction changes in accordance with the angle θ of the restriction, the angle θ must appropriately be determined.

Figure 19B:
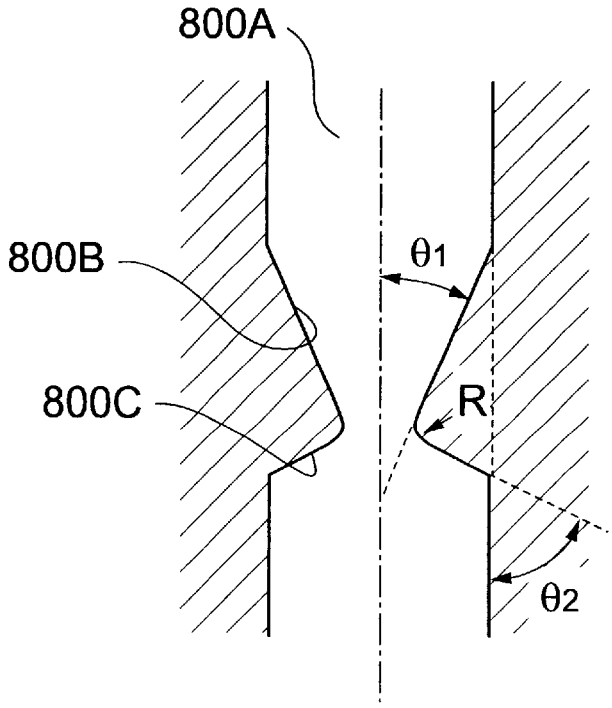
FIG. 19B is an explanatory view showing another detailed structure of the check valve.

Further, FIG. 19B shows another detailed structure of the check valve. This check valve 800A connects two conical surfaces 800B, 800C with each other. Assuming that angles defined by both the conical surfaces 800B, 800C and a central line are $\theta_1$, $\theta_2$, respectively, the angle $\theta_2$ is set so as to be larger than at least the angle $\theta_1$ ($\theta_2>\theta_1$), preferably not less than 80°, most preferably substantially 90°.

If the angle $\theta_2$ is greatly larger than 90°, air bubbles undesirably adhere to the conical surface 800C and accumulate when the liquid flows downwards from the upper side in FIG. 19B. Additionally, it has been revealed that the function as the check valve prominently lowers when the angle $\theta_2$ is not more than 60°. When a connection portion between both the conical surfaces 800B and 800C is formed into an appropriate arc-like curved surface as shown by R in the drawing, a flow of fluid can further be smoothed, which is more desirable.

Arrangement of Recording Head

Figure 20:
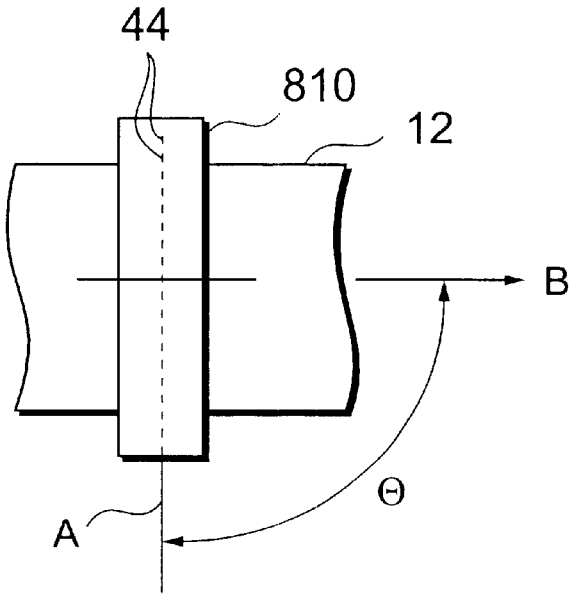
FIG. 20 is a view showing an example of arrangement of the image forming section (recording head) with respect to an image receiving medium.
Figure 21:
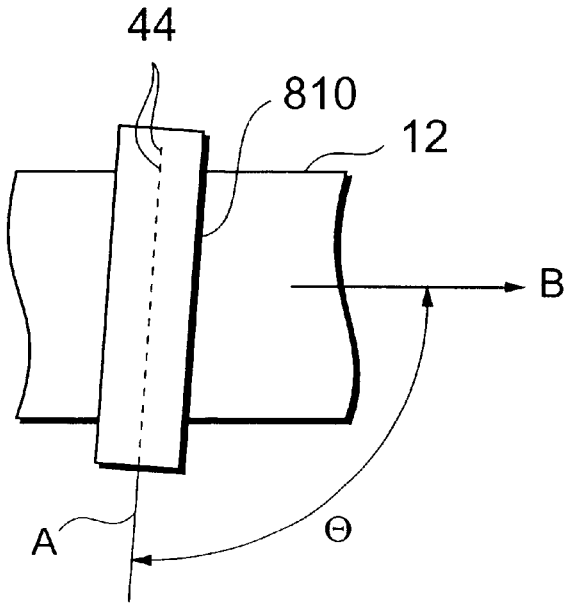
FIG. 21 is a view showing another example of arrangement of the image forming section.

FIGS. 20 and 21 are views showing examples of arrangement of the image forming section (recording head) for use in each of the foregoing embodiments. A recording head 810 shown in FIG. 20 has a plurality of ink ejection ports 44 aligned on a straight line A which is wider than the width of the image receiving medium, i.e., print paper. This recording head 810 is provided in such a manner that an angle Θ defined by an intersection of the straight line A on which the ink ejection ports 44 are aligned and a feeding direction B of the print paper 12 becomes 90° or substantially 90°. The image forming section 810 shown in FIG. 21 is inclined in such a manner that the angle Θ defined by an intersection of the straight line A and the feeding direction B does not become 90°.

According to the example shown in FIG. 20, the ink ejection ports 44 of the recording head 810 must be disposed at intervals which are equal to those of the pixels. According to the example shown in FIG. 21, an interval between the ink ejection ports 44 can be larger than that between the ink ejection ports shown in FIG. 20. As a result, production of the recording head 810 can be facilitated.

Figure 22:
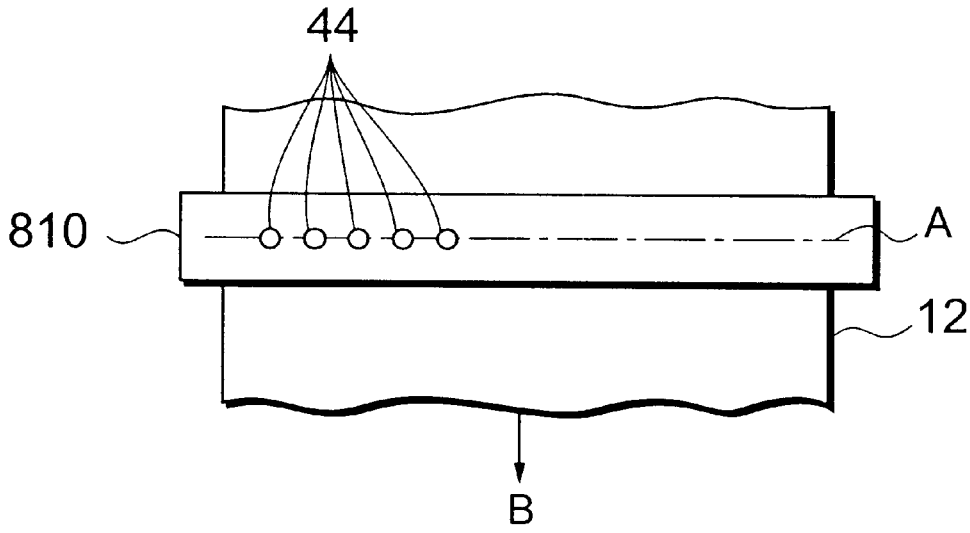
FIG. 22 is an enlarged view of the image forming section.
Figure 23:
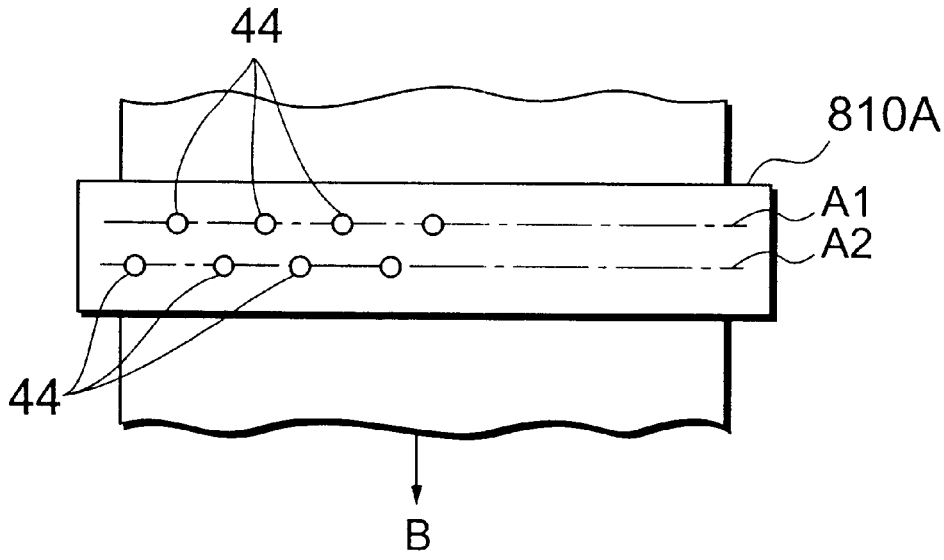
FIG. 23 is an enlarged view showing another embodiment of the image forming section.

FIG. 22 is an enlarged view of the image forming section 810, and FIG. 23 is an enlarged view showing another embodiment of the image forming section. As described above, the image forming section 810 has a large number of ink ejection ports 44 aligned on the straight line A. On the other hand, the adjacent ink ejection ports 44 are distributed on two parallel straight lines A1 and A2 in an image forming section 810A shown in FIG. 23.

According to the image forming section (recording head) 810A shown in FIG. 23, the interval between the adjacent ink ejection ports 44 on the respective straight line A1 and A2 can be enlarged to double the interval shown in FIG. 22. This can facilitate production of the image forming section 810A. Additionally, the ink ejection ports 44 can be distributed on three or more straight lines instead of the two straight lines A1 and A2, which further facilitates the production of the image forming section. When the ink ejection ports 44 are aligned on the different straight lines A1 and A2, a plurality of image forming sections having the ink ejection ports 44 aligned on one straight line can be displaced by an amount of pitch of the pixel in the width direction of the print paper 12 so as to closely overlap one on another.

In the aforementioned embodiments, the flow control valve (24, 26 or 624) changes the sectional area of the ink channel by driving the diaphragm valve by the piezoelectric device. In the ink flow controlling means including the check valve, cavity and movable member, the movable member is driven by the piezoelectric device. However, the flow control valve or the movable member may utilize the driving force based on a principle other than the piezoelectric device. For example, a heat-pressure effect, electrostatic attraction force, or electrostatic repulsive force can be used. On the heat-pressure effect described herein, the fluid (this may be the ink itself) whose flow resistance largely changes with a temperature is used and the diaphragm is driven by utilizing a fluid pressure change caused by changing a fluid temperature by a heater at one point in the fluid channel.

Furthermore, the diaphragm valve or the movable member may be driven by utilizing a magnetic distortion effect or an effect of interfacial tension of fluid different from fluids used for forming an image. Also, heat of fluids different from the fluid for use in forming the image and/or a pressure of a bubble generated by electrolytes may be used. Moreover, instead of changing the channel resistance by the heat with the heat-pressure effect, the channel resistance of the fluid different from a plurality of fluids for use in forming the image can be changed to generate a change in pressure of this fluid by changing other physical or chemical characteristics such as an electric field and magnetic field. This pressure change may be utilized to drive the diaphragm or the movable member.

It is possible to use the diaphragm for opening/closing the ink channel, which has a structure for holding a valve plate for closing the ink channel by a center impeller beam or a cantilever beam. That is, when the diaphragm has a structure such that the opening of the ink channel is substantially-vertically disposed opposite to the valve plate and this valve plate is pushed by an actuator such as a piezoelectric device from the opposite side of the opening of the ink channel, the center impeller beam or the cantilever beam is used as this valve plate.

In the embodiment shown in FIG. 2, the pumps 32, 34 eject or extrude the ink with a fixed pressure, and the ejection amount of each type of ink is separately controlled by the flow adjusting valves 24, 26. Further, in the embodiments shown in FIGS. 5 and 6, the ejection amounts of the ink from the pumps 132, 134, 232 and 234 are independently variable. Furthermore, in the embodiment shown in FIG. 7, each ink ejection amount is variable by the ink feed pumps 332 and 334.

In the present invention, each type of ink is supplied with the fixed pressure and the ejection amount is controlled by the flow adjusting valve (embodiment in FIG. 2), the ink ejection amount can be varied by each pump (the embodiments of FIGS. 5, 6 and 7), but a part of ink may be supplied with the fixed pressure and the ejection amount of any other type of ink may be varied. For example, the clear ink which becomes transparent and colorless at least after dried out may continuously be supplied with the fixed or constant pressure without using the flow adjusting valve. On the other hand, the ejection amount of any other colored ink may be varied by the flow control valve (shown in FIG. 2), the pump with a variable ejection amount (shown in FIGS. 5 and 6) or the ink feed pump with the variable ejection amount (shown in FIG. 7).

In this case, the sectional area of the ink channel through which all types of ink collectively pass is always constant, and the flow rate of one type of ink supplied with the fixed pressure naturally changes by varying the controllable ejection amount of the other type of ink. When the clear ink is supplied with the fixed pressure without using the flow control valve, the ink channel for the clear ink may be branched into a plurality of array-like channels in the recording head so that the clear ink can uniformly be led to each ink ejection port from one ink pump. Therefore, the constitution of the recording head can be simplified.

The above has been described as the embodiments for forming the image. That is, two-dimensionally drawing of the image on a sheet of paper or a film has been described. However, the present invention can be used for manufacturing a mosaic filter for use in an image display device such as a liquid crystal color display, that is, a color filter in which color mosaics of yellow, magenta and cyan are repeatedly arranged. Furthermore, the present invention can also be applied to manufacturing of an industrial product for forming a spatially repeated pattern.

In the present invention, the opening area of the channel of the ink whose ejection amount is minimum in the confluence is set to be smaller than the opening area of the other ink channel. Therefore, when the excessively small amount of ink is ejected into the confluence, an advancing amount of the leading end of the ink increases, and the leading end of the ink is easily disconnected. Therefore, the plurality of inks can be ejected with fidelity to the image signal, and the image quality can be enhanced.

The plurality of inks include at least one image non-forming ink and at least one image forming ink, and the opening area of the ink channel of the image forming ink in the ink confluence is set to be smaller than the opening area of the ink channel of the image non-forming ink, so that the ejection amount of the image forming ink can finely be controlled. This can realize a high-precision density control. In this case, when the opening of the image forming ink channel is circular, the opening area is Ai, the minimum ejection volume of the ink is Vi, and a relation $Ai \leqq \frac{1}{2} \times V^{(2/3)}$ is established, a preferable effect can usually be obtained.

When the plurality of inks constantly include the image non-forming ink, the ink is smoothly confluent. Particularly, when the ink total flow rate is constantly fixed, the ink fluid can steadily be transferred to the image receiving medium, and this is further suitable for enhancement of the image quality.

The ink ejection ports can be independently disposed for each pixel and opposite to the image receiving medium, and the ink liquid can be led into the image receiving medium by the ink transporting means of the ink jet mode. Examples of the ink jet mode for use herein include a piezo ink jet mode, thermal ink jet mode, continuous ink jet mode, electrostatic attraction ink jet mode, ultrasonic ink jet mode, and the like.

The ink liquid can be transferred as a continuous fluid flow to the image receiving medium via the ink ejection ports (continuous coating mode). In this case, when the respective ink ejection ports are formed in a common slot-opening and the ink liquid is ejected through this slot, a plurality of inks can be applied as the layer flow without being homogeneously mixed. A special property can be imparted to the ink coming into contact with the image receiving medium or the ink exposed on the surface. Therefore, the image quality can be improved. Additionally, the image receiving medium includes an intermediate image receiving medium such as a drum as well as the final image receiving medium such as the print paper.

The flow rate of at least one image forming ink for substantially forming the image when dried out among the plurality of inks is controlled in order to constantly prevent the volumetric flow rate per unit time from becoming zero. Then, the image quality can be prevented from being deteriorated by the diffused/mixed inks.

What is claimed is:

1. An image forming apparatus for ejecting a recording fluid constituted by a plurality of inks from a common ink ejection port while a mixing ratio of the plurality of inks is changed with respect to one pixel based on an image signal, and transporting the recording fluid to an image receiving medium which is moved with respect to the ink ejection port to form an image; said image forming apparatus comprising:

an ink ejection port for ejecting the recording fluid to the image receiving medium;

a first ink channel for supplying an image non-forming ink to said ink ejection port, the image non-forming ink being an ink for forming no image after dried out;

a second ink channel for supplying an image forming ink to said ink ejection port, the image forming ink being an ink for forming the image after dried out; and a mixing section disposed upstream of said ink ejection port, for mixing the image non-forming ink supplied from said first ink channel and the image forming ink supplied from said second ink channel;

wherein an opening area Ai of said second ink channel is smaller than the opening area of said first ink channel in said mixing section; and the opening area Ai of said second ink channel has the following relationship with a minimum ejection volume Vi of the image forming ink:

$$Ai \leqq 1.2 \times Vi^{(2/3)}.$$

2. The image forming apparatus according to claim 1, wherein the mixing ratio of the plurality of inks is controlled in such a manner that the image non-forming ink is always included.

3. The image forming apparatus according to claim 1, wherein a plurality of said ink ejection ports are provided to be aligned in accordance with respective pixels in a direction substantially perpendicular to a moving direction of the image receiving medium, and each of the ink ejection ports is independently disposed opposite to the image receiving medium.

4. The image forming apparatus according to claim 1, wherein said recording fluid is ejected from said ink ejection port and transported as a continuous recording fluid flow to the image receiving medium.

5. The image forming apparatus according to claim 4, wherein said image receiving medium is an intermediate image receiving medium for receiving the continuous recording fluid ejected from said ink ejection port and transferring the recording fluid to a final image receiving medium.

6. The image forming apparatus according to claim 1, wherein a plurality of ink ejection ports disposed for respective pixels are open into a slot, and the recording fluid ejected from each ink ejection port is transported as a band-shaped continuous fluid flow to the image receiving medium from the slot.

7. The image forming apparatus according to claim 6, wherein said image receiving medium is an intermediate image receiving medium for receiving the continuous recording fluid ejected from the ink ejection port and transferring the recording fluid to a final image receiving medium.

8. The image forming apparatus according to claim 1, further comprising ink transporting means for leading the recording fluid ejected from the ink ejection port to the image receiving medium by an ink jet mode.

9. The image forming apparatus according to claim 8, wherein the ink jet mode is any one selected from the group consisting of a piezo ink jet mode, a thermal ink jet mode, a continuous ink jet mode, an electrostatic attraction ink jet mode, and an ultrasonic ink jet mode.

10. The image forming apparatus according to claim 1, wherein an ink flow rate of the image forming ink is controlled in order to constantly prevent a volumetric flow rate per unit time from becoming zero.

11. An image forming method for ejecting a recording fluid constituted by a plurality of inks from a common ink ejection port while a mixing ratio of the plurality of inks is changed with respect to one pixel based on an image signal, and transporting the fluid to an image receiving medium which is moved with respect to the ink ejection port to form an image;

wherein said plurality of inks include an image non-forming ink which forms no image after dried out and at least one image forming ink which forms the image after dried out, an opening area Ai of a channel of said image forming ink is smaller than the opening area of the channel of said image non-forming ink in a confluence of said plurality of inks; and the opening area Ai of the channel of the image forming ink has the following relationship with a minimum ejection volume Vi of the image forming ink:

$$Ai \leqq 1.2 \times Vi^{(2/3)}.$$

12. The image forming method according to claim 11, wherein the mixing ratio of the plurality of inks is controlled in such a manner that the image non-forming ink is always included.

13. The image forming method according to claim 11, wherein a plurality of said ink ejection ports are provided to be aligned in accordance with respective pixels in a direction substantially perpendicular to a moving direction of the image receiving medium, and each of the ink ejection ports is independently disposed opposite to the image receiving medium.

14. The image forming method according to claim 11, wherein said fluid is ejected from said ink ejection port and transported as a continuous fluid flow to the image receiving medium.

15. The image forming method according to claim 14, wherein said image receiving medium is an intermediate image receiving medium for receiving the continuous recording fluid ejected from said ink ejection port and transferring the recording fluid to a final image receiving medium.

16. The image forming method according to claim 11, wherein a plurality of ink ejection ports disposed for respective pixels are open into a slot, and the recording fluid ejected from each ink ejection port is transported as a band-shaped continuous fluid flow to the image receiving medium from the slot.

17. The image forming method according to claim 16, wherein said image receiving medium is an intermediate image receiving medium for receiving the continuous recording fluid ejected from the ink ejection port and transferring the recording fluid to a final image receiving medium.

18. The image forming method according to claim 11, wherein the recording fluid ejected from the ink ejection port is transported to the image receiving medium by an ink jet mode.

19. The image forming method according to claim 18, wherein the ink jet mode is any one selected from the group consisting of a piezo ink jet mode, a thermal ink jet mode, a continuous ink jet mode, an electrostatic attraction ink jet mode, and an ultrasonic ink jet mode.

20. The image forming method according to claim 11, wherein an ink flow rate of the image forming ink is controlled so that a volumetric flow rate per unit time is constantly prevented from becoming zero.

* * * * *